US009941605B2

(12) United States Patent
Scanzillo et al.

(10) Patent No.: US 9,941,605 B2
(45) Date of Patent: Apr. 10, 2018

(54) WIRE CONNECTORS WITH BINDING TERMINALS

(71) Applicant: Hubbell Incorporated, Shelton, CT (US)

(72) Inventors: Thomas L. Scanzillo, Monroe, CT (US); Edward Bazayev, Kew Gardens, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/058,327

(22) Filed: Mar. 2, 2016

(65) Prior Publication Data

US 2017/0256869 A1 Sep. 7, 2017

(51) Int. Cl.
*H01R 4/66* (2006.01)
*H01R 4/30* (2006.01)

(52) U.S. Cl.
CPC ..... *H01R 4/305* (2013.01)

(58) Field of Classification Search
CPC ..... H01R 4/489; H01R 4/50; H01R 4/5008; H01R 4/4836; H01R 25/006
USPC ..... 439/107, 535, 536, 650; 174/53, 58–61, 174/67; 220/242
See application file for complete search history.

(56) References Cited

U.S. PATENT DOCUMENTS 2,466,930 A 4/1949 Cook
2,720,634 A 10/1955 Hart
3,093,433 A 6/1963 Ege
3,945,711 A 3/1976 Hohorst et al.
3,963,305 A 6/1976 Doktor et al.
4,563,054 A 1/1986 Wilmes
4,842,551 A 6/1989 Heimann
5,454,730 A 10/1995 Tozuka
5,494,456 A 2/1996 Kozel et al.
5,679,021 A 10/1997 Kramer
5,735,700 A 4/1998 Hohorst
5,816,867 A 10/1998 Davidsz et al.
5,839,908 A 11/1998 Bonilla
5,975,940 A 11/1999 Hartmann et al.
6,132,238 A 10/2000 Hartmann et al.
6,146,187 A 11/2000 Pallai
6,146,217 A 11/2000 Osada
6,155,890 A 12/2000 Gerberding
6,309,248 B1 10/2001 King
6,464,545 B2 10/2002 Yano
6,634,898 B2 10/2003 Clements
6,682,364 B2 1/2004 Cisey
6,719,581 B2 4/2004 Kikuchi
6,746,286 B2 6/2004 Blaha
6,774,307 B2 8/2004 Kruse
6,814,608 B2 11/2004 Kollmann
6,832,938 B2 12/2004 Lenker
6,911,602 B2 6/2005 Conrad
6,981,890 B2 1/2006 Cutler et al.
(Continued)

*Primary Examiner* — Vanessa Girardi
(74) *Attorney, Agent, or Firm* — Wissing Miller LLP

(57) ABSTRACT

Configurations for wire connectors and for electrical wiring devices that mate with or connect to the wire connectors are disclosed. The wire connectors have a housing and one or more contact assemblies positioned within the housing. Each contact assembly can receive and secure one or more wires, where the wires can be secured to or released from a contact assembly using a fastener accessible through an aperture in the housing.

31 Claims, 8 Drawing Sheets

(56) References Cited

U.S. PATENT DOCUMENTS

| | | | |
|---|---|---|---|
| 6,994,585 | B2 | 2/2006 | Benoit |
| 7,083,463 | B2 | 8/2006 | Steinkemper et al. |
| 7,115,001 | B1 | 10/2006 | Brockman et al. |
| 7,131,857 | B2 | 11/2006 | Mueller |
| 7,140,887 | B2 | 11/2006 | Poh et al. |
| 7,179,137 | B1 | 2/2007 | Quendt et al. |
| 7,238,043 | B2 | 7/2007 | Reibke et al. |
| 7,241,188 | B2 | 7/2007 | Lin et al. |
| 7,249,963 | B2 | 7/2007 | Ramm |
| 7,281,942 | B2 | 10/2007 | Swedberg et al. |
| 7,384,319 | B2 | 6/2008 | Kirstein et al. |
| 7,402,075 | B1 | 7/2008 | Probst |
| 7,438,587 | B2 | 10/2008 | Germani |
| 7,527,509 | B1 | 5/2009 | Bethurum et al. |
| 7,628,640 | B2 | 12/2009 | Radle |
| 7,645,158 | B2 | 1/2010 | Mulhouse et al. |
| 7,651,363 | B2 | 1/2010 | Koellmann |
| 7,690,952 | B2 | 4/2010 | Koellmann et al. |
| 7,749,018 | B1 | 7/2010 | Benoit |
| 7,794,268 | B2 | 9/2010 | Breen, IV et al. |
| 7,815,463 | B2 | 10/2010 | Gerberding |
| 7,845,970 | B2 | 12/2010 | Stromiedel |
| 7,896,686 | B2 | 3/2011 | Hoppe |
| 7,963,812 | B2 | 6/2011 | Ilkhanov |
| 7,976,330 | B2 | 7/2011 | Lin |
| 8,096,818 | B2 | 1/2012 | Arenas et al. |
| 8,235,748 | B2 | 8/2012 | Lacey et al. |
| 8,344,250 | B2 | 1/2013 | Padro |
| 8,466,367 | B2 | 6/2013 | Reibke |
| 8,613,624 | B2 * | 12/2013 | Arenas ..... H01R 9/2491 439/107 |
| 8,771,008 | B1 | 7/2014 | Black |
| 9,099,258 | B2 | 8/2015 | Padro |
| 9,130,285 | B2 | 9/2015 | Scanzillo |
| 2002/0052139 | A1 | 5/2002 | Gormann |
| 2013/0072046 | A1 | 3/2013 | Bazagev et al. |
| 2013/0280956 | A1 | 10/2013 | Cheng |
| 2014/0170877 | A1 | 6/2014 | Scanzillo et al. |
| 2014/0170908 | A1 | 6/2014 | Scanzillo et al. |

* cited by examiner

WIRE CONNECTORS WITH BINDING TERMINALS

BACKGROUND

Field

The present disclosure relates generally to wire connectors for terminating electrical wires. More particularly, the present disclosure relates to wire connectors for terminating electrical wires having binding terminals to facilitate electrically and mechanically engaging inserted electrical wires.

Description of the Related Art

Some electrical wiring devices have apertures in their rear faces for receiving a plug terminating a plurality of wires. The wires terminated by the plug are connected to existing building wires in any suitable manner, such as by a clamp receptacle or a twist-on wire connector. However, connecting each plug wire to a building wire with the twist-on wire connector, or similar device, requires time and skill to make the connection. Additionally, a significant amount of wire needs to be inserted in the electrical box when connecting the electrical receptacle to an electrical box. The large amount of wire can be difficult to pack into the electrical box with the electrical wiring device. Providing a plug that mates with an aperture in a rear surface of the electrical wiring device and terminates existing building wires through a push wire connection reduces time to install, and increase the area within an electrical box in which to pack electrical wires.

SUMMARY

Configurations for wire connectors and for electrical wiring devices that mate with or connect to the wire connectors are disclosed. Generally, the wire connectors have a housing and one or more contact assemblies positioned within the housing. In one exemplary configuration, the wire connector includes a housing having at least one cavity, at least one housing wire opening, and a plug member for mating with an electrical wiring device. The at least one housing wire opening extends between the at least one cavity and an outer surface of the housing. At least a portion of the plug member includes a portion of the at least one cavity. The plug member also includes at least one slot for receiving a contact blade aligned with the portion of the at least one cavity. The wire connector also includes at least one contact assembly positioned within the at least one cavity. The at least one contact assembly includes a contact member having a contact body and a contact extending from the contact body at least partially into the plug member, and a mechanical tightening terminal coupled to the contact member. The mechanical tightening terminal is at least partially accessible from the outer surface of the terminal, and may be, for example, a screw binding terminal. The screw binding terminal includes a fixed terminal body, a movable terminal body, and a screw that passes through the fixed terminal body and is threaded through the movable terminal body such that turning the screw renders the movable terminal body movable relative to the fixed terminal body. The screw is accessible from the outer surface of the housing.

In another exemplary configuration, the wire connector includes a housing having at least one cavity, at least one housing wire opening extending between the at least one cavity and an outer surface of the housing, a plug member for mating with an electrical wiring device, and a cover. At least a portion of the plug member includes a portion of the at least one cavity, and the plug member has at least one slot for receiving a contact blade aligned with the portion of the at least one cavity. The cover is movable between an open position and a closed position. The wire connector also includes at least one contact assembly positioned within the at least one cavity. The at least one contact assembly includes a contact member having a contact body and a contact extending from the contact body at least partially into the plug member. The at least one contact assembly also includes a screw binding terminal coupled to the contact member and having a screw that is at least partially accessible from the outer surface of the housing, wherein the cover prevents access to the screw accessible from the outer surface of the housing when in the closed position, and wherein the cover permits access to the screw accessible from the outer surface of the housing when in the open position.

In one exemplary configuration, the electrical device kit includes an electrical device, and a wire connector similar to the wire connector described above.

BRIEF DESCRIPTION OF THE DRAWINGS

The figures depict configurations for purposes of illustration only. One skilled in the art will readily recognize from the following description that alternative configurations of the structures illustrated herein may be employed without departing from the principles described herein, wherein.

DETAILED DESCRIPTION

Figure 1:
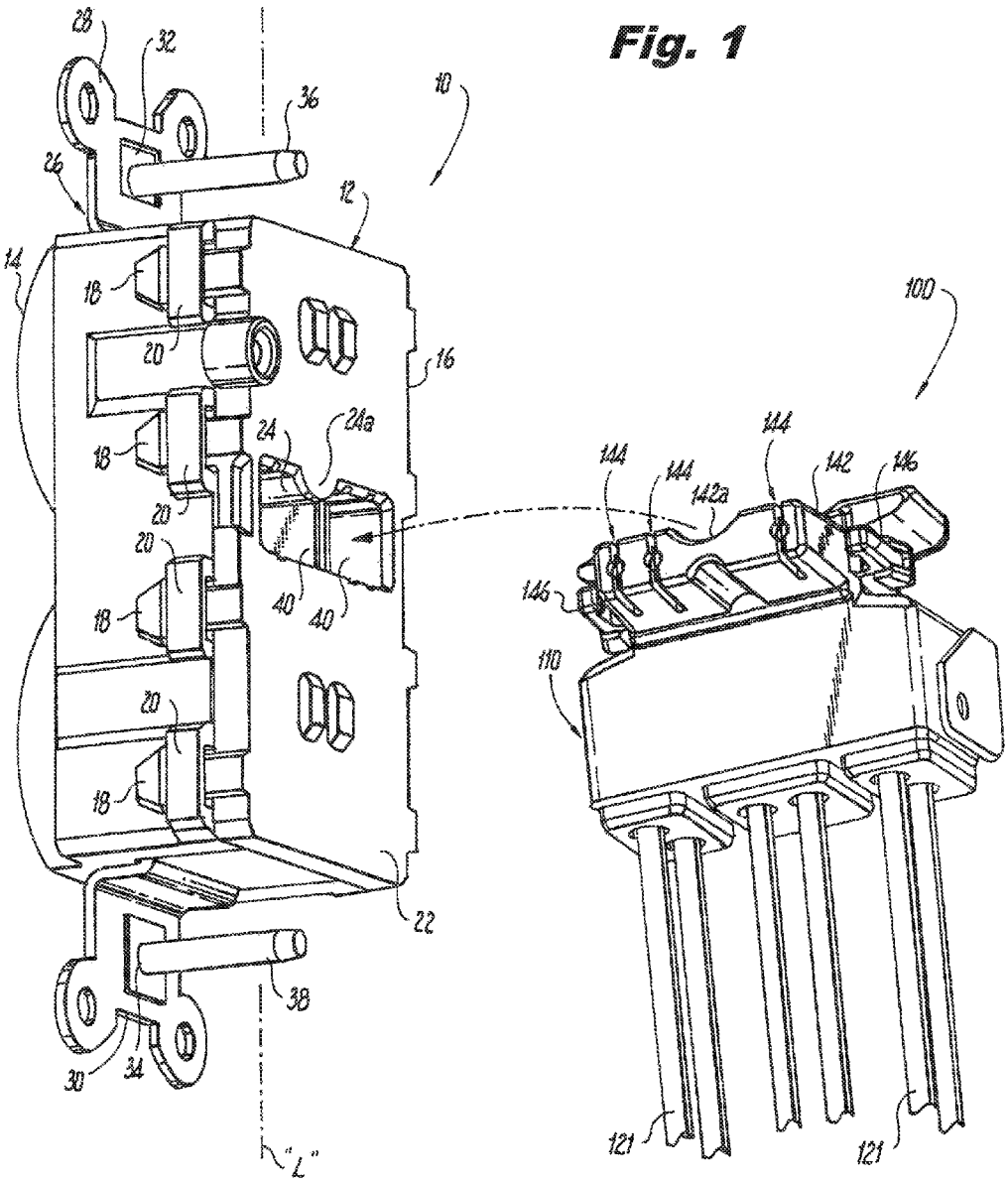
FIG. 1 is rear perspective view of an exemplary configuration of an electrical wiring device, and a front perspective view of an exemplary configuration of a wire connector according to the present disclosure forming a kit.

The present disclosure provides descriptions of configurations for wire connectors, and for electrical wiring devices that mate with or connect to the wire connectors. Referring to FIG. 1, an exemplary configuration of an electrical wiring device 10 and a wire connector 100 according to the present disclosure are shown. In this exemplary configuration, the electrical wiring device 10 includes a housing 12 having a cover 14 connected to a base 16. The base 16 can have a plurality of extending posts 18 that are received within pockets 20 of the cover 14 creating a snap fit to secure the cover 14 to the base 16. The base 16 has a rear surface 22, and an aperture 24 disposed in the rear surface. The aperture 24 is adapted to receive the wire connector 100, as will be described in more detail below. A ground or mounting strap 26 is connected to the housing 12, and is adapted to secure the electrical wiring device 10 to an electrical box (not shown). The ground strap 26 has mounting ears 28 and 30 disposed at opposite ends of the ground strap. Each mounting ear 28 and 30 has an opening 32 and 34 to receive a fastener 36 and 38 used to secure the electrical wiring device 10 to an electrical box in a conventional manner. The ground strap 26 may be disposed between the cover 14 and the base 16, or the ground strap 26 may wrap around the rear surface 22 of the base 16 and up along the sides of the cover 14. Within the housing 12 are the known components that form the operational features of the electrical wiring device 10. For example, if the electrical wiring device 10 is a duplex receptacle, the internal components of the receptacle would include flexible fingers forming female contact assemblies to receive the blades of a plug, and the electrical connections between the female contact assemblies and their respective contact blades 40 described below.

The electrical wiring device 10 also includes a plurality of contact blades 40 disposed within the housing 12, and electrically connected to female contacts that are accessible through a front surface of the cover 14. The contact blades 40 are accessible through the aperture 24 in base 16. In the exemplary configuration of FIG. 1, the electrical wiring device 10 is a duplex receptacle, such that the cover 14 of the housing 12 has two sets of three openings to receive an electrical plug of an electrical apparatus or appliance to be powered by the electrical wiring device 10. For each of the two sets of openings, one of the three openings has a female contact assembly that connects to the hot leg of the power wires, one of the three openings has a female contact assembly that connects to the neutral leg of the power wires, and one of the three openings has a female contact assembly that connects to ground. Thus, in the configuration of FIG. 1, three contact blades 40 are disposed in the housing 12 and accessible via aperture 24. The three contact blades 40 are arranged so that two outer contact blades 40 correspond to hot and neutral contact assemblies within the housing 12, and a middle contact blade 40 corresponds to a ground contact assembly within the housing 12. When the wire connector 100 is mated with the electrical wiring device, the hot contact assemblies would also be connected to the hot contact blade 40, the neutral contact assemblies would also be connected to the neutral contact blade 40, and the ground contact assemblies would also be connected to the ground contact blade 40.

While the configuration shown in FIG. 1 is described as having three contact blades 40, one skilled in the art would readily appreciate that any suitable number of contact blades may be used in the electrical wiring device 10. A more detailed description of the electrical wiring device 10 is provided is commonly owned U.S. Pat. No. 9,130,285, which is incorporated herein in its entirety by reference. Further, the electrical wiring device shown in FIG. 1 and described herein is a duplex receptacle. However, the electrical wiring device 10 used with the wire connector 100 may be, for example, a single receptacle, a circuit interrupting receptacle, e.g., a GFCI receptacle, a single pole switch, a three-way switch, a dimmer switch, or any similar electrical wiring device. Further, the number of contact blades 40 accessible through the aperture 24 would depend upon the particular electrical wiring device 10 that the wire connector 100 is to connect to. For example, if the electrical wiring device 10 were a single pole switch, there would be three contact blades 40 accessible through the aperture 24. One contact blade would be for the hot leg, one contact blade would be for the neutral leg, and one contact blade would be for the ground. As another example, if the electrical wiring device 10 were a three-way switch, there would be four contact blades 40 accessible through the aperture 24. One contact blade would be for the hot leg, two contact blades would be for traveler legs, and one contact blade would be for the ground.

Figure 2:
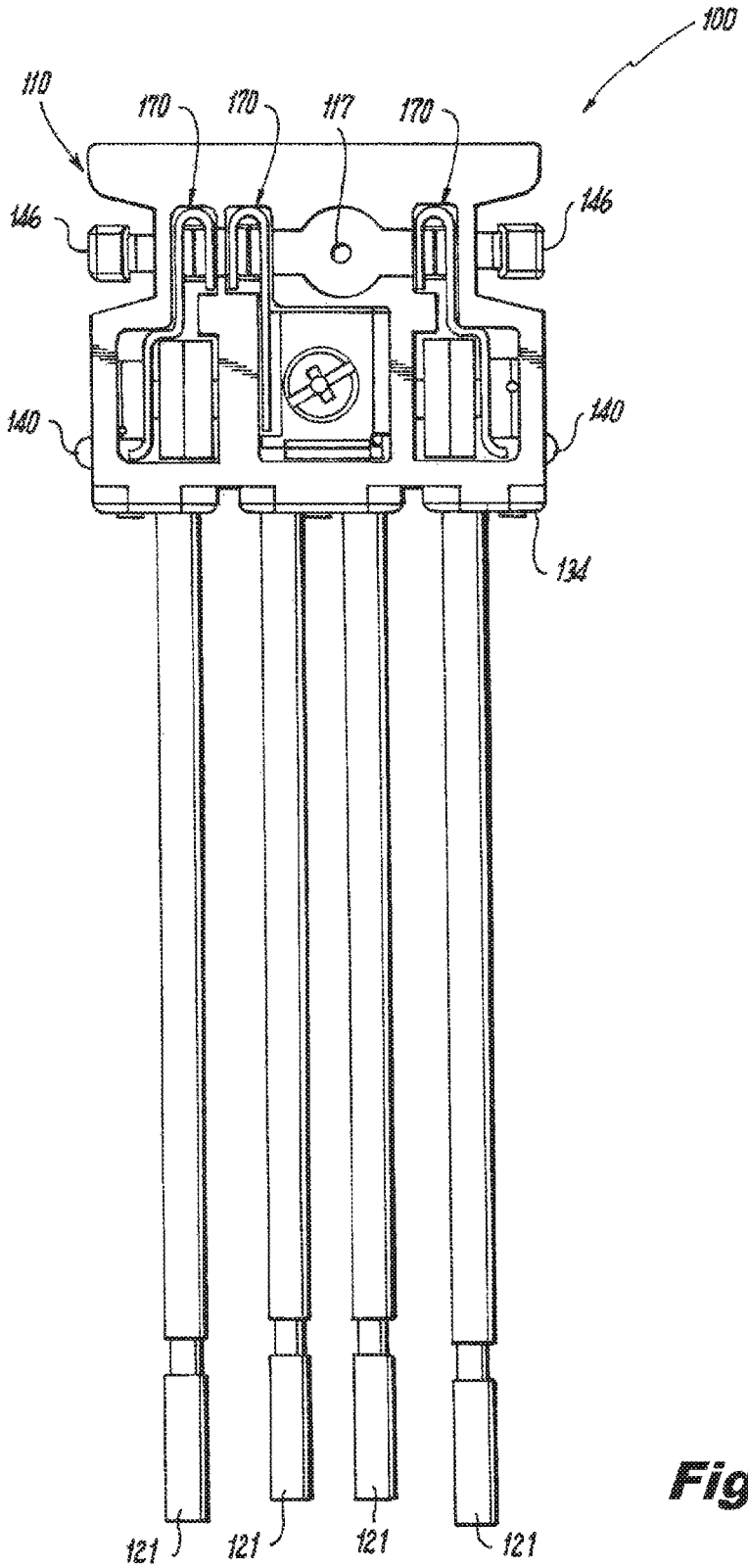
FIG. 2 is a top plan view of the wire connector of FIG. 1 with a cover removed from a base of a terminal housing.
Figure 3:
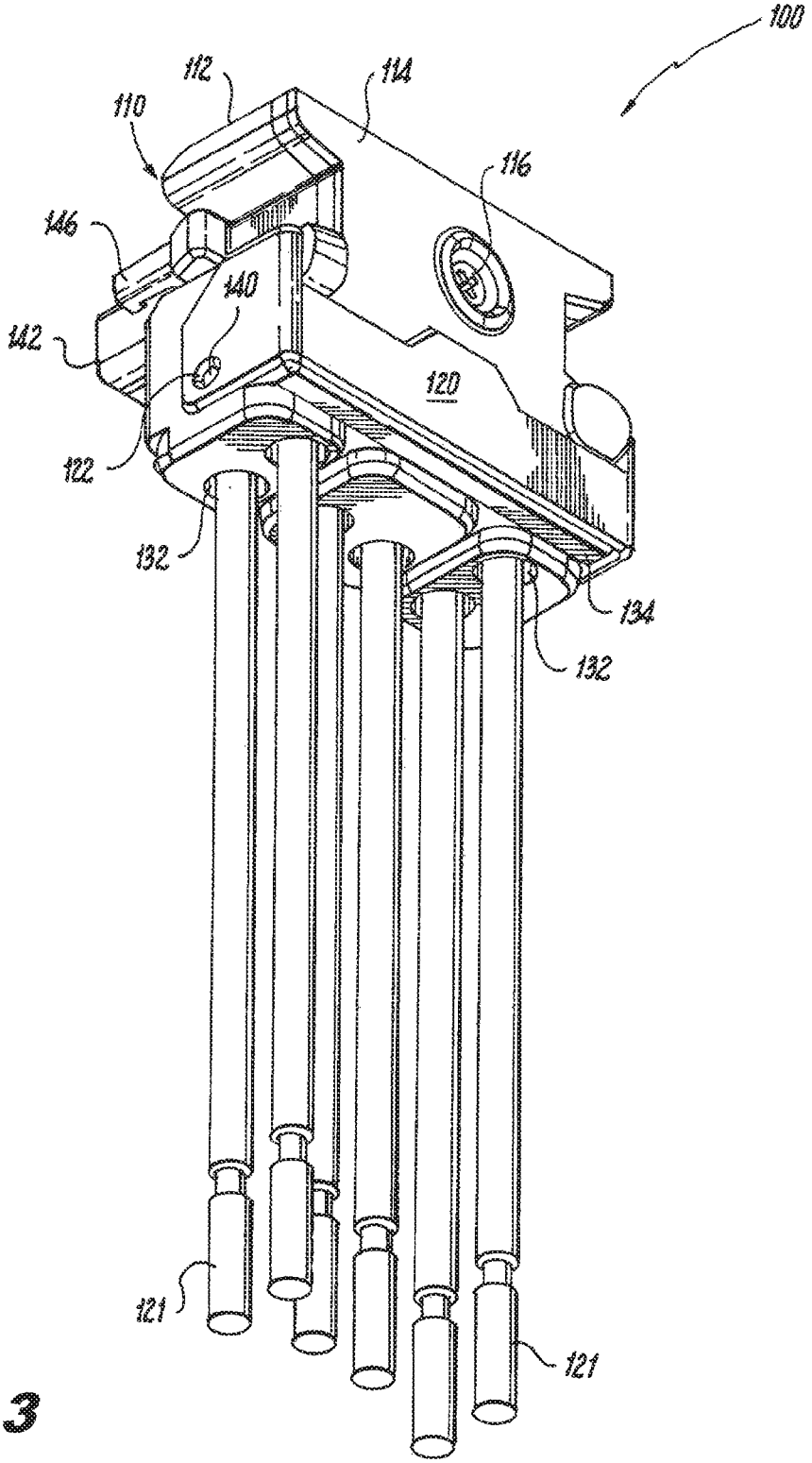
FIG. 3 is a rear perspective view of the wire connector of FIG. 1, illustrating a movable cover in a closed position.

Referring now to FIGS. 2-7, the wire connector 100 includes a terminal housing 110 and a plurality of contact assemblies 170 within the terminal housing. As seen in FIGS. 2 and 3, the terminal housing 110 has a base 112 and a cover 114 that connects to the base 112. The terminal housing 110 is preferably made of a non-conductive material, such as injection molded thermoplastic. The base 112 can be secured to the cover 114 using mechanical fasteners, adhesives, or welds such as sonic welds. In the configuration shown in FIGS. 3 and 4, a mechanical fastener 116 secured to a mounting aperture 117 in base 112 is used.

Figure 6:
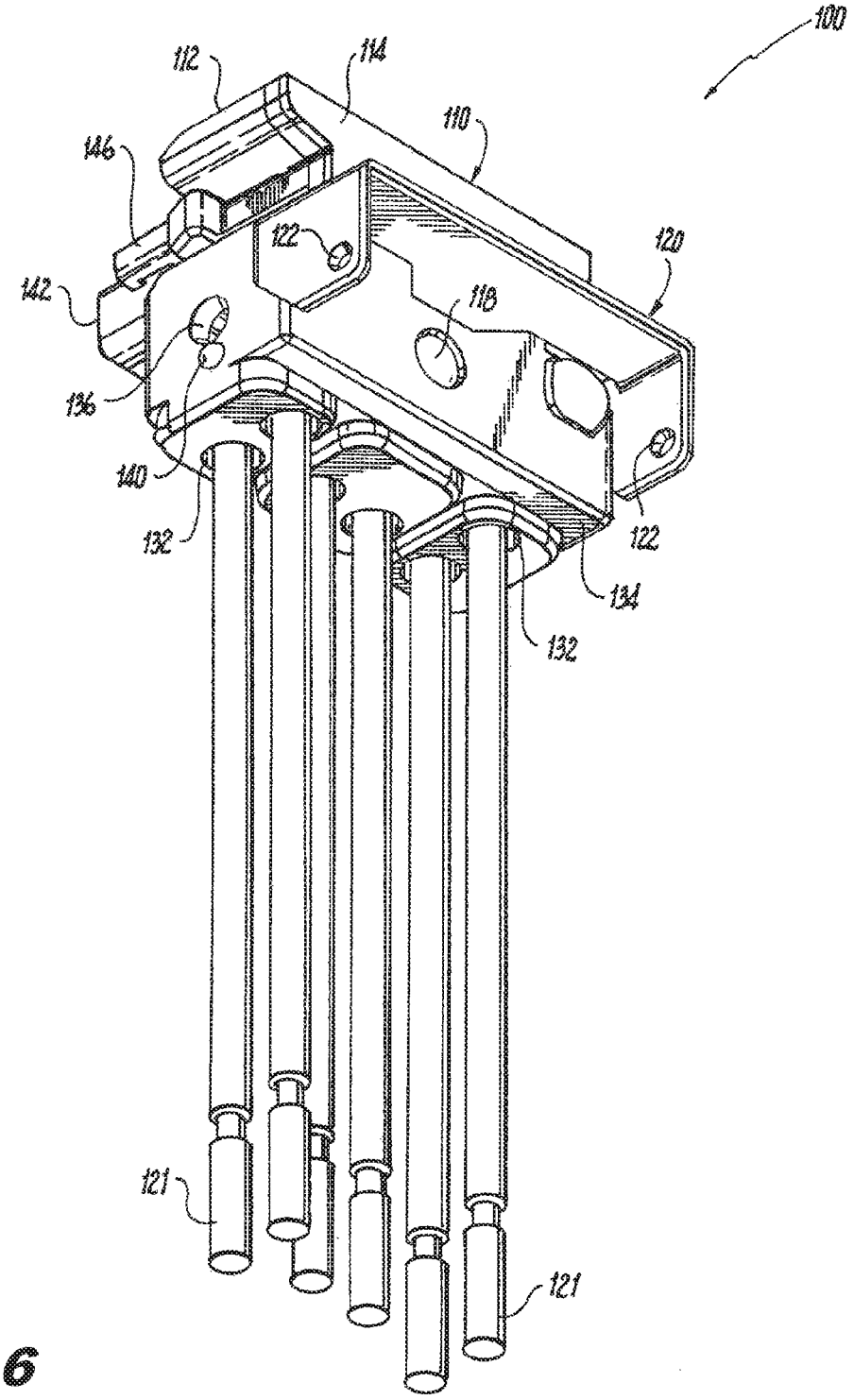
FIG. 6 is a rear perspective view of the wire connector of FIG. 1, illustrating the movable cover in an open position exposing terminal apertures.
Figure 8:
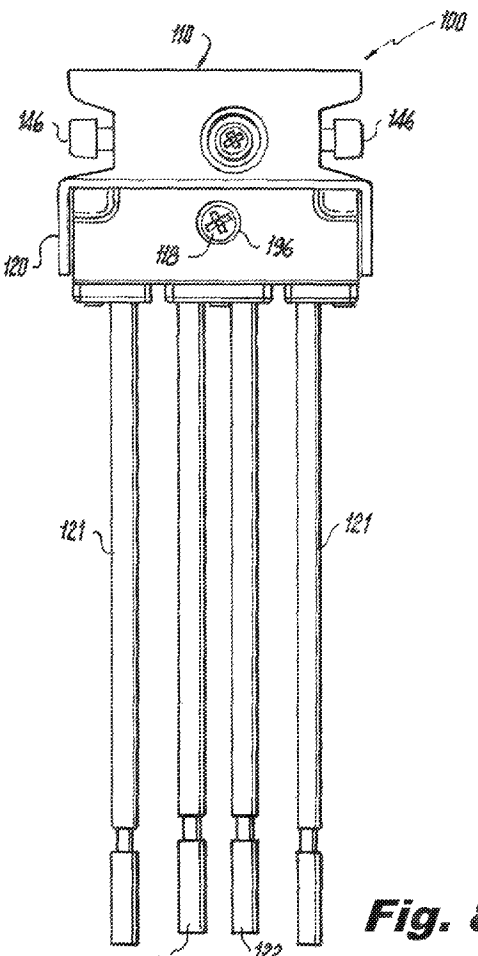
FIG. 8 is a rear elevation view of the wire connector of FIG. 6.
Figure 7:
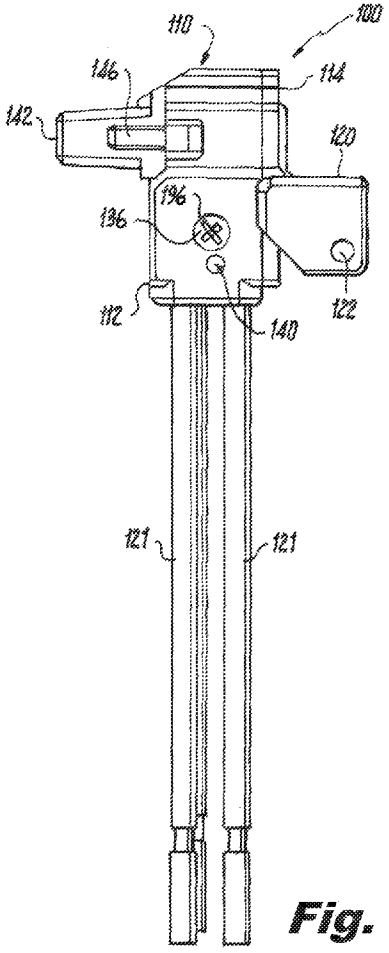
FIG. 7 is a left side elevation view of the wire connector of FIG. 6.

The cover 114 includes a terminal aperture 118, seen in FIG. 8, that extends into a center cavity 130 within the base 112, and a movable cover 120 that can move between a closed position, shown in FIG. 3, and an open position, shown in FIG. 6. In the closed position, the movable cover 120 covers the terminal aperture 118, and terminal apertures in the base, which are described in more detail below. When moving the cover to the closed position, opening 122 in cover 120 snaps onto projection 140 in base 112 to maintain the cover in the closed position.

Figure 4:
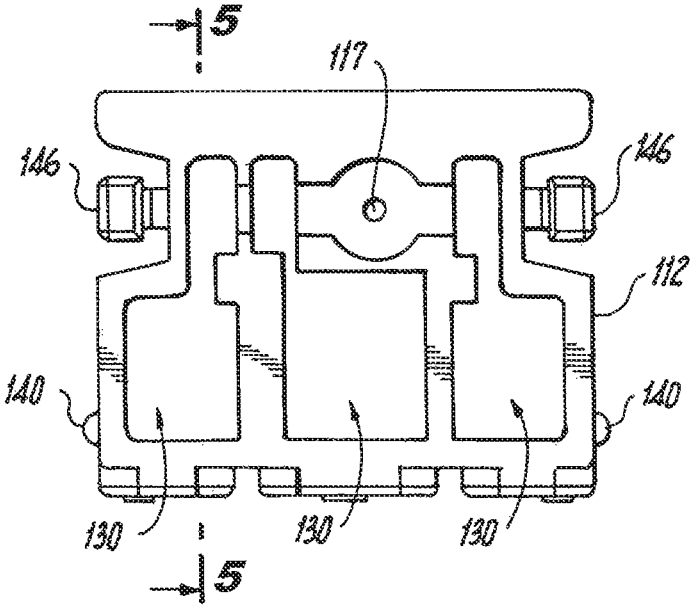
FIG. 4 is a top plan view of a terminal housing base for the wire connector of FIG. 1.
Figure 5:
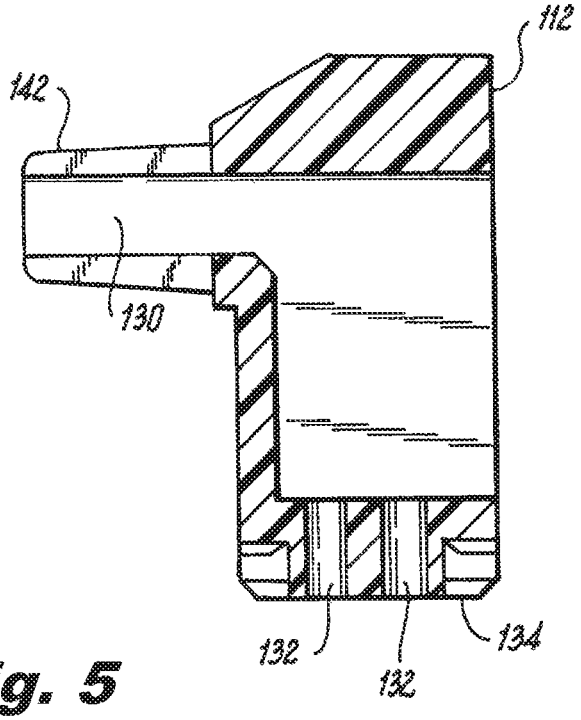
FIG. 5 is a side cross-sectional view of the terminal housing base of FIG. 4 taken along line 5-5.
Figure 9:
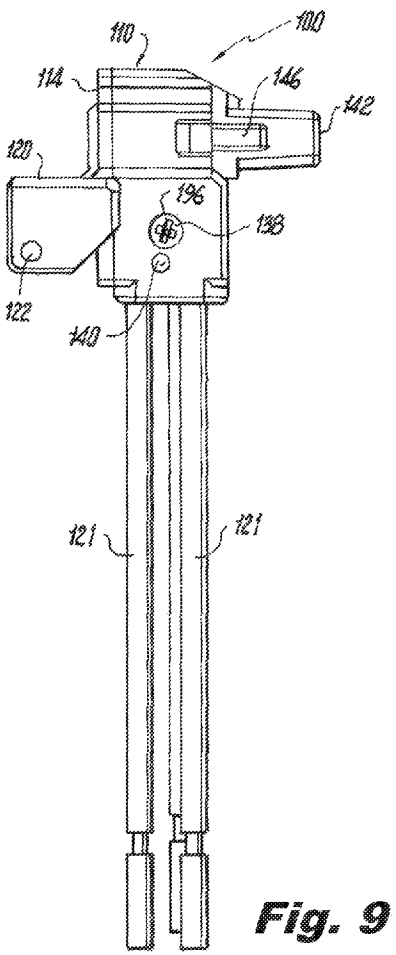
FIG. 9 is a right side elevation view of the wire connector of FIG. 6.

The base 112 includes one or more cavities 130 configured to receive the contact assemblies 170. In the configuration of FIGS. 2-6, the base 112 has three cavities 130, each configured to receive one contact assembly 170. However, one skilled in the art would readily recognize that the terminal housing 110 can have one cavity, two cavities, or more than three cavities in the base 112 that can receive one or more contact assemblies 170. A plurality of apertures or wire openings 132 are formed in the base 112 to receive power wires 121. The wire openings 132 are preferably disposed on the same side of the base 112, and extend from a bottom surface 134 of the base 112 to a respective cavity 130 within the base 112, as seen in FIGS. 2 and 5. Each side of the base 112 includes terminal apertures 136 and 138, seen in FIGS. 7 and 9, that extend through the base 112 into a corresponding cavity 130 in the base. The terminal apertures 118, 136 and 138 permit access to a contact terminal 190 of the contact assembly 170, as will be described in more detail below.

The base 112 also includes a plug connector 142 that is configured to be inserted into the aperture 24 in the electrical wiring device 10, and mate with the contact blades 40. The plug connector 142 includes a portion of the cavity 130 for receiving flexible fingers of the contact assembly 170. The flexible fingers form a female contact that can receive a contact blade 40, which is in this exemplary configuration a male contact. The plug connector 142 also includes one or more openings or slots 144, seen in FIG. 1, to receive the contact blades 40 of an electrical wiring device 10.

The base 112 also includes a pair of latching arms 146. The latching arms 146 are disposed on opposite sides of the base 112, as shown in FIGS. 3 and 4. The latching arms 146 are flexible members that facilitate latching the wire connector 100 to the electrical wiring device 10, and that facilitate unlatching the wire connector 100 from the electrical wiring device 10. The latching arms 146 are configured to interact with overhangs 17 positioned on the sides of the base 16 adjacent to aperture 24, as seen in FIG. 1. Interaction between the overhangs 17 and the latching arms 146 releasable latches the wire connector 100 to the electrical wiring device 10. More specifically, when the connector plug 142 of the wire connector 100 is inserted into the aperture 24, the latching arms 146 flex away from the terminal housing 110 so that the latching arms 146 pass over the overhangs 17 on the base 16, and then snap back when the latching arms 146 pass beyond the overhangs 17. To release the wire connector 100 from the electrical wiring device 10, the latching arms 146 are flexed away from the terminal housing 110 and the wire connector 100 is pulled out of the aperture 24.

Figure 10:
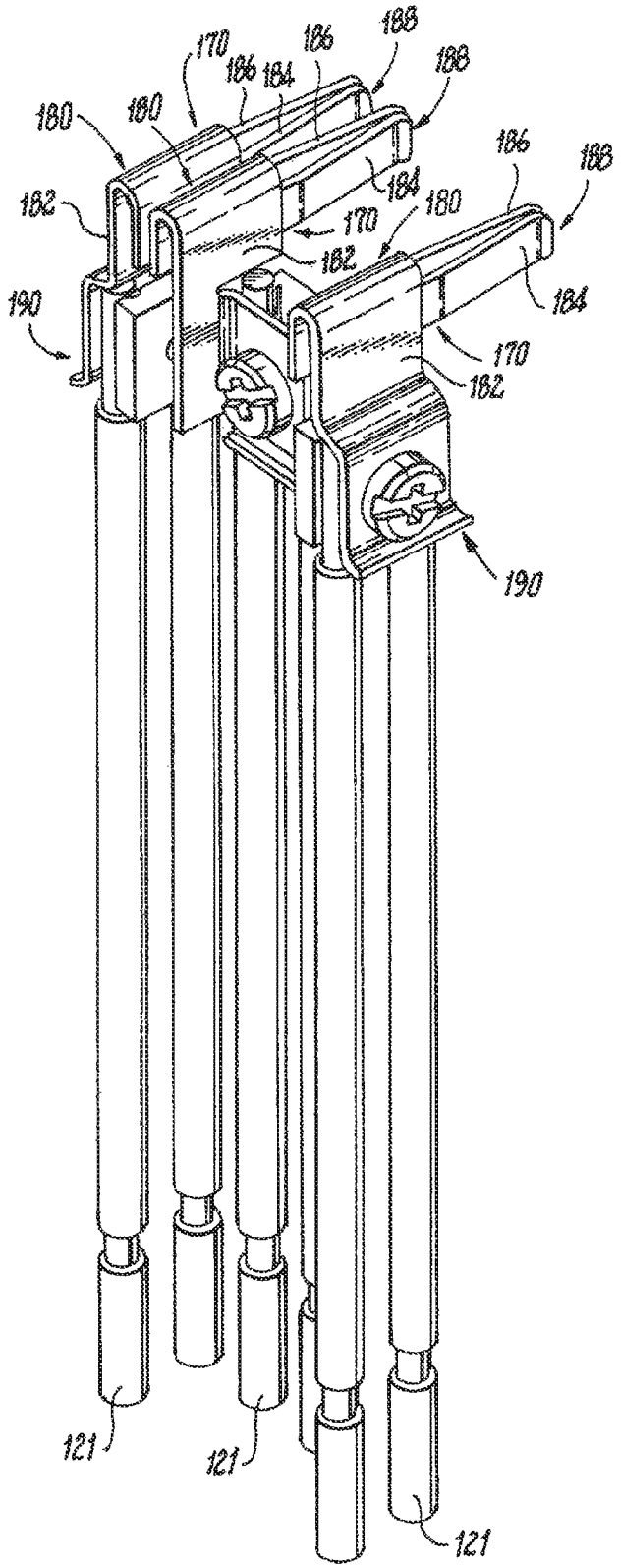
FIG. 10 is a bottom perspective view of an exemplary configuration of multiple contact assemblies with wire leads extending from contact terminals.
Figure 11:
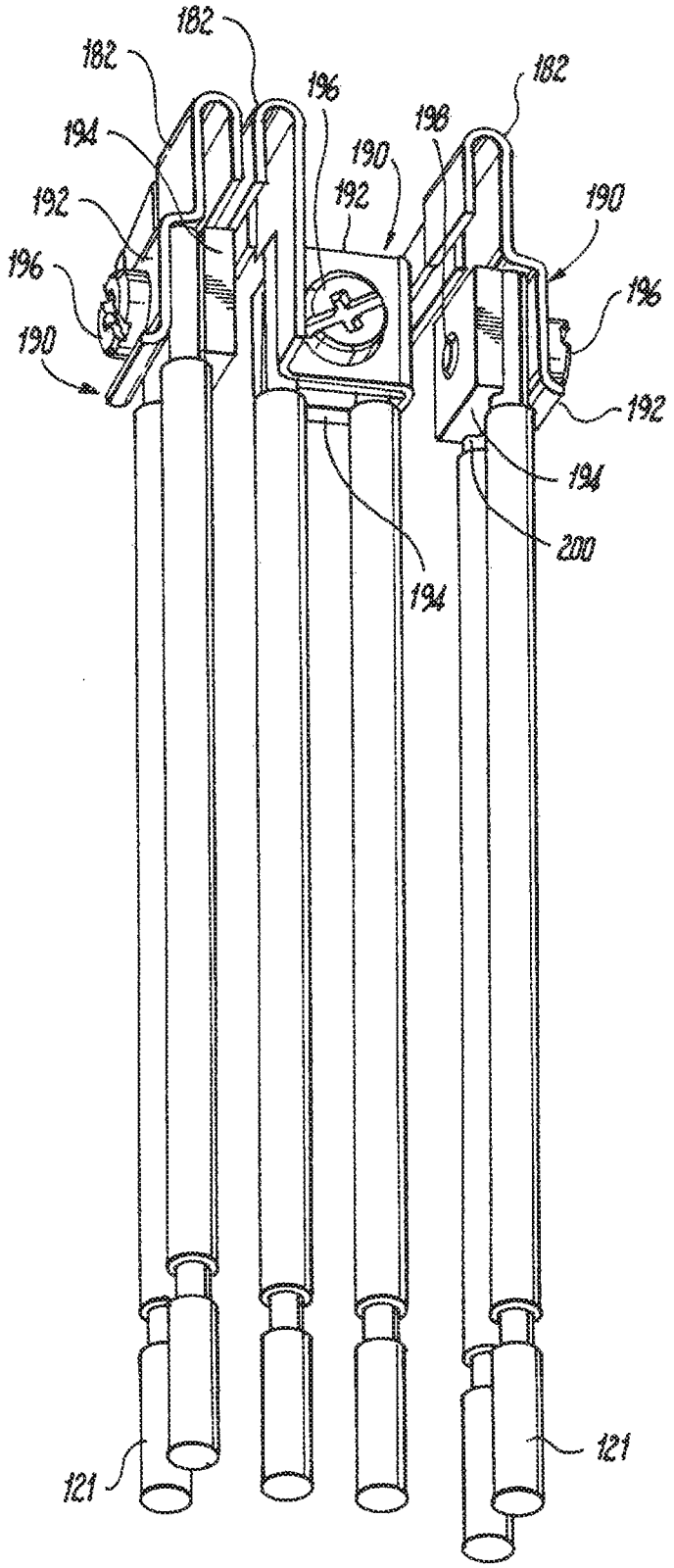
FIG. 11 is a top perspective view of the multiple contact assemblies with wire leads of FIG. 10.

Referring now to FIGS. 10 and 11, an exemplary configuration of the contact assembly 170 according to the present disclosure is shown. In this exemplary configuration, the contact assembly 170 includes a contact member 180 and a contact terminal 190. The contact member 180 and contact terminal 190 are made of an electrically conductive material, such as brass or aluminum. The contact member 180 and the contact terminal 190 are formed as a unitary structure, or the contact member and terminal can be secured together by a solder joint, a brazed joint, or a welded joint. The contact member 180 includes a contact body 182, and a pair of flexible fingers 184 and 186 extending from the contact body 182, as shown in FIG. 10. The flexible fingers 184 and 186 form a female contact configured to engage a contact blade 40 in the electrical wiring device 10. The flexible fingers 184 and 186 of the contact member 180 contact each other to form a gripping portion 188 between the fingers, seen in FIG. 10, that is capable of receiving a contact blade 40, so as to electrically couple or connect the contact member 180 to the contact blade 40. Thus, each contact assembly 170 is adapted to engage one of the plurality of contact blades 40 in the electrical wiring device 10.

The contact terminal 190 is a mechanical tightening terminal that uses mechanical techniques to tighten one or more wires to the contact terminal 190. In an exemplary configuration shown, the contact terminal 190 is a binding terminal having a fixed terminal body 192 that is substantially planar and fixed to the contact body 182, and a movable body 194. The fixed terminal body 192 has an aperture sized to allow a fastener 196, such as a machine screw, to pass through. The movable body 194 is adapted to receive the fastener or couple with the fastener so that activating the fastener causes the movable terminal body to move relative to the fixed terminal body. For example, the movable body can have a threaded aperture 198 for receiving the fastener 196. The contact terminal 190 is used to terminate one or more wires 121 inserted into the contact assembly 170. One or more wires 121 are inserted into wire openings 132 in the terminal housing 110. The wires 121 pass through the terminal housing 110 and between the fixed terminal body 192 and the movable terminal body 194. The fastener 196 is then tightened so that the movable terminal body 194 moves toward the fixed terminal body 192, thus securing the wire 121 to the contact terminal 190. The movable body 194 may include one or more wire receiving grooves 200, such as V-shaped or U-shaped grooves, that receive at least a portion of one or more wires 121 to help maintain the wire in a fixed position relative to the movable body 194.

As described herein, the wire connector 100 uses the contact assemblies 170 to terminate power wires 121 within an electrical box. To connect power wires 121 within an electrical box to the wire connector 100, an installer, e.g., an electrician, first strips the insulation from the end of each wire. The power wires 121 are then inserted into the appropriate wire opening 132 in the rear surface 134 of the base 112. The wire openings 132 guide the bare end of the wire into a corresponding groove 200 on the movable body 194 between the fixed body 192 and the movable body 194. When the bare end of the wire 121 is positioned between the fixed terminal body 192 and the movable terminal body 194, the fastener 196 is then tightened via terminal apertures 118, 136, or 138.

Preferably, the wire connector 100 has three contact members 170 corresponding to the hot, neutral and ground power wires 121. Each contact member 170 has a contact terminal 190 is capable of receiving and securing two wires, each inserted separately in wire opening 132 in the terminal housing 110. As a result, the wire connector 100 can terminate six wires—two hot wires, two neutral wires and two ground wires. However, one skilled in the art would readily appreciated that the wire connector 100 may be configured to terminate less or more wires.

To connect or mate the wire connector 100 to the electrical wiring device 10, the installer aligns the connector plug 142 with the aperture 24 in the electrical wiring device 10. In the configuration of the connector plug 142 shown in FIG. 1, the connector plug 142 may include a keyway, e.g., an arched portion 142*a*, that aligns with a key, e.g., an inverted arch 24*a*, in the rear surface 22 of the base 16 to ensure that the connector plug 142 is properly aligned with the aperture 24. When the connector plug 142 is properly aligned with the aperture 24, force is applied to the terminal housing 110 so that the connector plug 142 enters the aperture 24, as contact blades 40 slide into the slots 144 in the connector plug 142 and between the respective flexible fingers 184 and 186. When the connector plug 142 of the wire connector 100 is fully within the aperture 24, the latching arms 146 flex away from the terminal housing 110 so that the latching arms 146 pass over the overhangs 17 on the base 16, and then snap back when the latching arms 146 pass beyond the overhangs 17. At this point, the wire connector 100 is latched to the electrical wiring device 10. To release the wire connector 100 from the electrical wiring device 10, the latching arms 146 are flexed away from the terminal housing 110 and the wire connector 100 is pulled out of the aperture 24.

The wires terminated by the wire connector 100 extend from the base 112 of the terminal housing 110 and substantially perpendicular to the connector plug 142, as seen in FIG. 1. As such, the plurality of wires 121 are substantially parallel to a longitudinal axis "L" of the electrical wiring device 10 when the wire connector 100 is connected to the electrical wiring device 10. Having the wires 121 substantially parallel to a longitudinal axis of the electrical wiring device provides more area within an electrical box in which to mount the electrical wiring device. Alternatively, the wires 121 can be terminated such that the wires extend from the base 112 of the terminal housing 110 and are substantially perpendicular or at another angle relative to the longitudinal axis of the electrical wiring device 10.

Using the electrical wiring device and wire connector of the present disclosure, power wires can be quickly and easily inserted into and secured to the wire connector, and the wire connecter can be quickly and easily connected to the electrical wiring device. As a result, electrical continuity can be established between the existing power wires and the electrical wiring device quickly and easily. While illustrative configuration s of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A wire connector, comprising:

a housing comprising:

a plurality of cavities;

at least one housing wire opening extending between each of the plurality of cavities and an outer surface of the housing;

a plug member for mating with an electrical wiring device, wherein at least a portion of the plug member includes a portion of each of the plurality of cavities and a plurality of slots, wherein one of the plurality of slots corresponds to one of the plurality of cavities, and wherein each slot is configured to receive a contact blade of the electrical wiring device;

a plurality of terminal apertures extending between the plurality of cavities and the outer surface of the housing such that one of the plurality of apertures extends from one of the plurality of cavities to the outer surface of the housing; and a single cover coupled to the housing and configured to move between an open position permitting access to the plurality of terminal apertures and a closed position covering the plurality of apertures; and a plurality of contact assemblies, wherein one of the plurality of contact assemblies is positioned within the one of the plurality of cavities, and wherein each contact assembly comprises:

a contact member having a contact body and a pair of flexible fingers extending from the contact body that form a gripping portion to receive the contact blade so as to electrically couple the contact member to the contact blade; and a mechanical tightening terminal coupled to the contact member and aligned with one of the plurality of terminal apertures.

2. The wire connector according to claim 1, wherein the mechanical tightening terminal is at least partially accessible through one of the plurality of terminal apertures.

3. The wire connector according to claim 1, wherein the plurality of cavities comprise a first cavity, a second cavity and a third cavity.

4. The wire connector according to claim 3, wherein the at least one housing wire opening comprises a first housing wire opening extending between the first cavity and the outer surface of the housing, a second housing wire opening extending between the second cavity and the outer surface of the housing, and a third housing wire opening extending between the third cavity and the outer surface of a base.

5. The wire connector according to claim 3, wherein the the plurality of contact assemblies comprise a first contact assembly positioned in the first cavity, a second contact assembly positioned in the second cavity, and a third contact assembly positioned in the third cavity.

6. The wire connector according to claim 3, wherein the plurality of slots comprise a first slot aligned with a portion of the first cavity, a second slot aligned with a portion of the second cavity, and a third slot aligned with a portion of the third cavity.

7. The wire connector according to claim 3, wherein the at least one housing wire opening comprises a first set of housing wire openings, a second set of housing wire openings, and a third set of housing wire openings, wherein each housing wire opening in the first set extends between the first cavity and the outer surface of the housing, wherein each housing wire opening in the second set extends between the second cavity and the outer surface of the housing, and wherein each housing wire opening in the third set extends between the third cavity and the outer surface of the housing.

8. The wire connector according to claim 7, wherein the first set of housing wire openings comprises two housing wire openings, the second set of housing wire openings comprises two housing wire openings, and the third set of housing wire openings comprises two housing wire openings.

9. The wire connector according to claim 1, wherein the mechanical tightening terminal comprises a screw binding terminal.

10. The wire connector according to claim 9, wherein the screw binding terminal includes a fixed terminal body, a movable terminal body, and a screw that passes through the fixed terminal body and is threaded through the movable terminal body such that turning the screw renders the movable terminal body movable relative to the fixed terminal body.

11. The wire connector according to claim 10, wherein the screw is accessible through one of the plurality of terminal apertures.

12. The wire connector according to claim 10, wherein the cover prevents access to the screw accessible through one of the plurality of terminal apertures when in the closed position, and permits access to the screw accessible through one of the plurality of terminal apertures when in the open position.

13. An electrical device kit comprising:

an electrical wiring device; and a wire connector comprising:

a housing comprising:

a plurality of cavities;

at least one housing wire opening extending between each of the plurality of cavities and an outer surface of the housing;

a plug member for mating with the electrical wiring device, wherein at least a portion of the plug member includes a portion of each of the plurality of cavities and a plurality of slots, and wherein each slot is configured to receive a contact blade of the electrical wiring device;

a plurality of terminal apertures extending between the plurality of cavities and the outer surface of the housing such that one of the plurality of apertures extends from one of the plurality of cavities to the outer surface of the housing; and a single cover coupled to the housing and configured to move between an open position permitting access to the plurality of terminal apertures and a closed position covering the plurality of apertures; and a plurality of contact assemblies, wherein one of the plurality of contact assemblies is positioned within one of the plurality of cavities, and wherein each contact assembly comprises:

a contact member having a contact body and a pair of flexible fingers extending from the contact body that form a gripping portion to receive the contact blade, so as to electrically couple the contact member to the contact blade; and a mechanical tightening terminal coupled to the contact member and aligned with one of the plurality of terminal apertures.

14. The electrical device kit according to claim 13, wherein the mechanical tightening terminal is at least partially accessible through one of the plurality of terminal apertures.

15. The electrical device kit according to claim 13, wherein the electrical wiring device comprises a duplex receptacle.

16. The electrical device kit according to claim 13, wherein the electrical wiring device comprises a single pole switch.

17. The electrical device kit according to claim 13, wherein the electrical wiring device comprises a three way switch.

18. The electrical device kit according to claim 13, wherein the electrical wiring device comprises a single receptacle.

19. The electrical device kit according to claim 13, wherein the electrical wiring device comprises a circuit interrupting receptacle.

20. The electrical device kit according to claim 13, wherein the mechanical tightening terminal comprises a screw binding terminal.

21. The electrical device kit according to claim 20, wherein the screw binding terminal includes a fixed terminal body, a movable terminal body, and a screw that passes through the fixed terminal body and is threaded through the movable terminal body such that turning the screw renders the movable terminal body movable relative to the fixed terminal body.

22. The electrical device kit according to claim 20, wherein the screw is accessible through one of the plurality of terminal apertures.

23. The electrical device kit according to claim 22, wherein the cover prevents access to the screw accessible through one of the plurality of terminal apertures when in the closed position, and permits access to the screw accessible through one of the plurality of terminal apertures when in the open position.

24. The electrical device kit according to claim 13, wherein the plurality of cavities comprise a first cavity, a second cavity and a third cavity.

25. The electrical device kit according to claim 24, wherein the at least one housing wire opening comprises a first housing wire opening extending between the first cavity and the outer surface of the housing, a second housing wire opening extending between the second cavity and the outer surface of the housing, and a third housing wire opening extending between the third cavity and the outer surface of a base.

26. The electrical device kit according to claim 24, wherein the plurality of contact assemblies comprise a first contact assembly positioned in the first cavity, a second contact assembly positioned in the second cavity, and a third contact assembly positioned in the third cavity.

27. The electrical device kit according to claim 24, wherein the plurality of slots comprise a first slot aligned with a portion of the first cavity, a second slot aligned with a portion of the second cavity, and a third slot aligned with a portion of the third cavity.

28. The electrical device kit according to claim 24, wherein the at least one housing wire opening comprises a first set of housing wire openings, a second set of housing wire openings, and a third set of housing wire openings, wherein each housing wire opening in the first set extends between the first cavity and the outer surface of the housing, wherein each housing wire opening in the second set extends between the second cavity and the outer surface of the housing, and wherein each housing wire opening in the third set extends between the third cavity and the outer surface of the housing.

29. The electrical device kit according to claim 28, wherein the first set of housing wire openings comprises two housing wire openings, the second set of housing wire openings comprises two housing wire openings, and the third set of housing wire openings comprises two housing wire openings.

30. A wire connector, comprising:

a housing comprising:

a plurality of cavities;

at least one housing wire opening extending between each of the plurality of cavities and an outer surface of the housing;

a plug member for mating with an electrical wiring device, wherein at least a portion of the plug member includes a portion of each of the plurality of cavities and a plurality of slots, and wherein each slot is configured to receive a contact blade of the electrical wiring device;

a plurality of terminal apertures extending between the plurality of cavities and the outer surface of the housing such that one of the plurality of apertures extends from one of the plurality of cavities to the outer surface of the housing; and a single cover coupled to the housing and configured to move between an open position permitting access to the plurality of terminal apertures and a closed position covering the plurality of apertures; and a plurality of contact assemblies, wherein one of the plurality of contact assemblies is positioned within one of the plurality of cavities, and wherein each contact assembly comprises:

a contact member having a contact body and a pair of flexible fingers extending from the contact body that form a gripping portion to receive the contact blade, so as to electrically couple the contact member to the contact blade; and a screw binding terminal coupled to the contact member and having a screw that is at least partially accessible through one of the plurality of terminal apertures, wherein the cover prevents access to the screw accessible through one of the plurality of terminal apertures when in the closed position, and wherein the cover permits access to the screw accessible through one of the plurality of terminal apertures when in the open position.

31. The wire connector according to claim 30, wherein the screw binding terminal includes a fixed terminal body, a movable terminal body, and the screw that passes through the fixed terminal body and is threaded through the movable terminal body such that turning the screw renders the movable terminal body movable relative to the fixed terminal body.

* * * * *